United States Patent [19]

Ritter

[11] 4,056,063

[45] Nov. 1, 1977

[54] DISPATCHER FOR CONVEYOR SYSTEM

[75] Inventor: Bruno Ritter, Malente Gremsmuhlen, Germany

[73] Assignee: Buro Patent AG, Glarus, Switzerland

[21] Appl. No.: 756,611

[22] Filed: Jan. 4, 1977

Related U.S. Application Data

[63] Continuation of Ser. No. 599,053, July 25, 1975, abandoned.

[30] Foreign Application Priority Data

July 27, 1974 Germany ..... 2436376

[51] Int. Cl.[2] ..... B61J 3/00

[52] U.S. Cl. ..... 104/88; 198/352

[58] Field of Search ..... 104/88; 198/350, 351, 198/352; 214/11 R, 11 C, 16.4 B

[56] References Cited

U.S. PATENT DOCUMENTS

| | | | |
|---|---|---|---|
| 3,171,362 | 3/1965 | Noye | 104/88 |
| 3,340,821 | 9/1967 | Wesener | 104/88 |
| 3,502,038 | 3/1970 | Wesener | 104/88 |

*Primary Examiner*—Trygve M. Blix
*Assistant Examiner*—Reinhard J. Eisenzopf
*Attorney, Agent, or Firm*—Karl F. Ross

[57] ABSTRACT

A conveyor system has a plurality of cars displaceable along a track and each having a side provided with a plurality of parallel guides each in turn receiving a respective code marker slidable along the respective guide and arrestable therein at any of a plurality of predetermined index positions. The pattern defined by the markers in the index position determines the path of travel of the respective car on the track. A dispatcher is provided comprising a support adjacent the track and a plurality of rows of encoders on the support. Each row is alignable with a respective guide on one of the cars and each encoder is also alignable with the respective position on the respective guide. The encoders each comprise a remotely operable abutment pin projectable from the support into the respective guide such that displacement of a car past a support having one such abutment pin on each such row projecting from the support displaces the respective markers along the respective guides. Apparatus is provided for displacing the abutment pins and the side of the car away from each other when the desired address code has been set on the side of the car by displacement of the markers with the abutment.

10 Claims, 5 Drawing Figures

DISPATCHER FOR CONVEYOR SYSTEM

This is a continuation of application Ser. No. 599,053 filed July 25, 1975 now abandoned.

FIELD OF THE INVENTION

The present invention relates to a conveyor system. More particularly this invention concerns a dispatch apparatus for a conveyor system having a plurality of cars displaceable over a track to various remote stations.

BACKGROUND OF THE INVENTION

A conveyor system is known having a plurality of cars displaceable along a track and each having a side provided with a plurality of parallel guides. Each such guide receives a respective code marker which is slidable along the guide and arrestable therein at any of a plurality of predetermined index positions. The markers are set in a pattern in their various index positions which determines a path of travel of the respective car on the track toward a remote station. Switches at various intersections of the track are operated by scanners that can read the pattern on the side of the car and shunt the car onto the proper track section to route this car to the destination determined by the address indexed in the markers.

When the car arrives at its location the user places the article to be transported in it and usually readdresses the car simply by manually displacing the markers into the positions corresponding to the location to which the car is to be sent. The car is then set back in motion on the track. When the user at the receiving station has no need for the car he sets on the car the address code for a holding area where the cars not in use are kept.

Such a conveyor installation usually has self-propelled cars, each of which has its own drive motor. The tracks themselves or a third rail may provide the electricity to power the vehicles, or each may have its own storage battery in which case rechargers are provided at the holding area. Each car is in effect a small bin that can transport small objects within a processing plant, warehouse, or the like.

It is known to provide at the holding area a dispatcher for setting the address code and sending off the cars. Such a device has pins which are inserted in holes corresponding to the code to be set. Once the proper address code has been set the entire dispatch device is pivoted away from the side of the car. Such a device is invariably extremely complicated and does not lend itself to automation of the system.

OBJECTS OF THE INVENTION

It is therefore an object of the present invention to provide an improved conveyor system.

Another object is the provision of an improved dispatcher for such a system.

Yet another object is to provide a conveyor system having a dispatching arrangement which can automatically and rapidly function to place the desired address code on the cars as they exit from the holding area, even without the necessity of stopping the cars.

SUMMARY OF THE INVENTION

These objects are attained according to the present invention by providing a support affixed adjacent the track and carrying a plurality of rows of encoders. Each row of encoders is alignable with the respective guide on one of the cars and each encoder is alignable with a respective position on the respective guide. In addition each encoder has a remotely operable abutment member displaceable from a retracted position into a position projecting into the respective guide. Thus displacement of a car past a support having one such member in each such row projecting from the support displaces the respective markers along the respective guides. Means is provided for displacing the abutment members and the side apart to disengage them from each other when the guides of the car align with the rows of the support.

Thus in accordance with the present invention the car may ride on the track past the dispatching apparatus. The appropriate abutment members of the appropriate encoders will be actuated to project outwardly so that as this car moves past the markers thereon will be displaced along their guides. When the car is directly across from the dispatching apparatus the abutment members and the side are separated so that the markers are left in their set positions. This entire operation can take place as the car moves, without the necessity of stopping it at all.

According to another feature of this invention an arresting device for the drive of the car may be provided actuatable when the abutments have slid the marks into the desired address code. A simple blocking element may be employed or an electric arrangement to shut off the drive of the car. It is also possible to reverse the drive of the car after the address setting has been made, or the car can continue in its original direction after withdrawing of the abutments. This type of arrangement makes the time at which the abutments are withdrawn less critical.

According to the present invention it is possible to displace the side and the abutment members apart by providing means for pushing the entire track section adjacent the support away from the support. Thus a railroad-switch arrangement is provided which is automatically actuated when the guides of the car are aligned with the rows of markers on the dispatcher to shunt the car over to another track section. In this arrangement it is not necessary to stop the car, as once the proper alignment is obtained the switching device is actuated to pull the car away from the dispatcher. In such an arrangement the criticality of the instant in which the abutment members are withdrawn is also eliminated.

In accordance with the present invention means is provided for detecting exact alignment of the car with the dispatcher. Thus when the index positions of the car are each aligned with the respective encoder on the dispatcher the switch is activated to either withdraw the abutment members, or to operate the siding shifter. This means may comprise according to the present invention a small permanent magnet mounted on the side of the car and alignable with a reed switch on the dispatcher. Since the transport cars in such systems typically move at relatively low rates of speed, and since modern electronic means provide for virtually instantaneous switching, it is possible in such an arrangement to set an address code on a car as it moves past the dispatcher, without stopping the car.

According to yet another feature of this invention each of the encoders comprises a magnetic coil mounted on the support and a core constituting the abutment member. A spring is provided to hold the core in a normally withdrawn position so that only energization of the coil may advance the core. Thus all of the cores are operated by respective relays connected to a common register into which is fed from a remote station a call signal requesting a car to be sent. In addition all of these relays are connected in series with a switch operated by the alignment-sensing means so that the instant the car is properly aligned with the dispatcher all of the cores are withdrawn by their springs and, after a suitable delay, a new registration may be set in the coders for addressing the next car.

BRIEF DESCRIPTION OF THE DRAWING

The above and other objects, features, and advantages will become readily apparent from the following, reference being made to the accompanying drawing in which.

SPECIFIC DESCRIPTION

Figure 1:
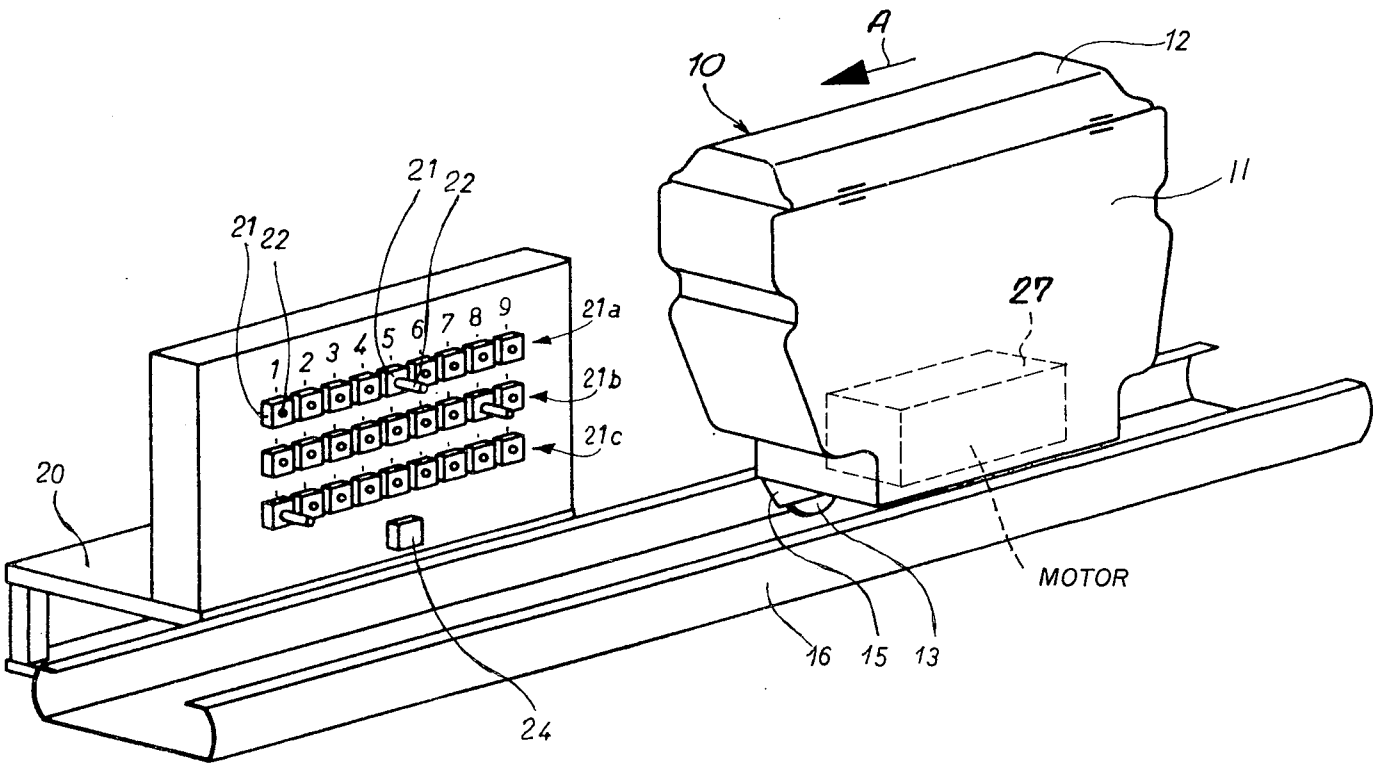
FIG. 1 is a perspective view of the portion of the system according to the present invention.
Figure 2:
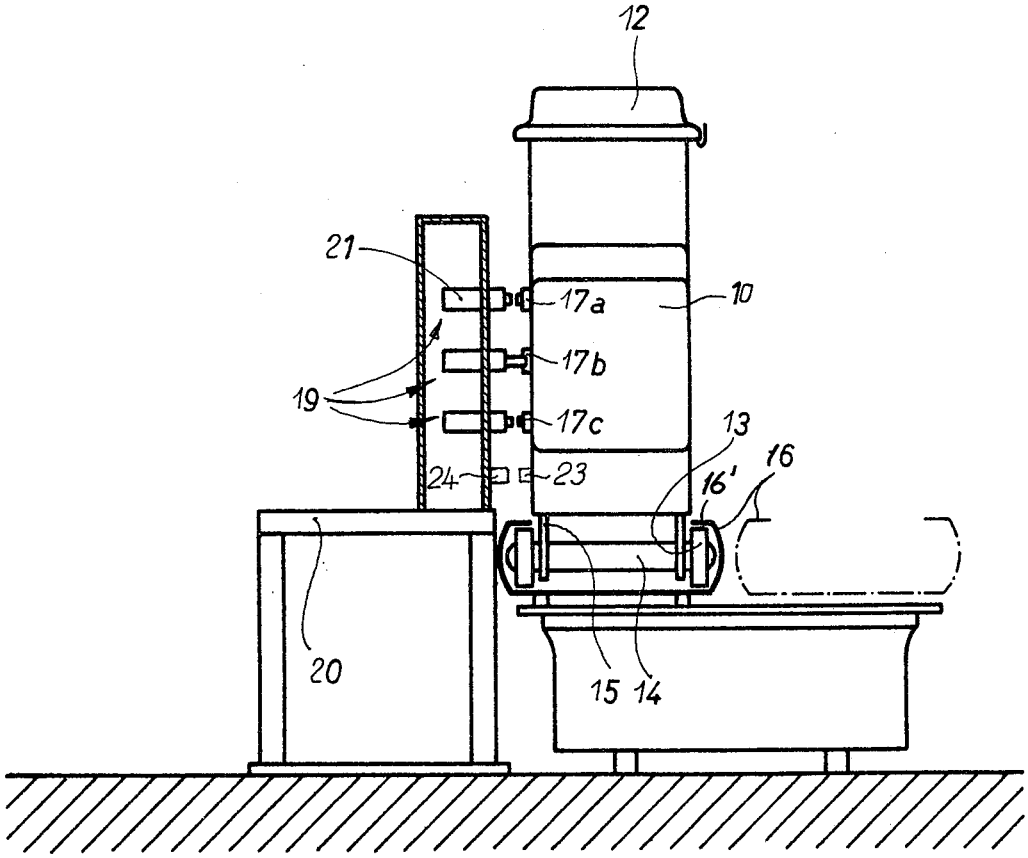
FIG. 2 is a cross section of the dispatcher at a track switch according to this invention.
Figure 3:
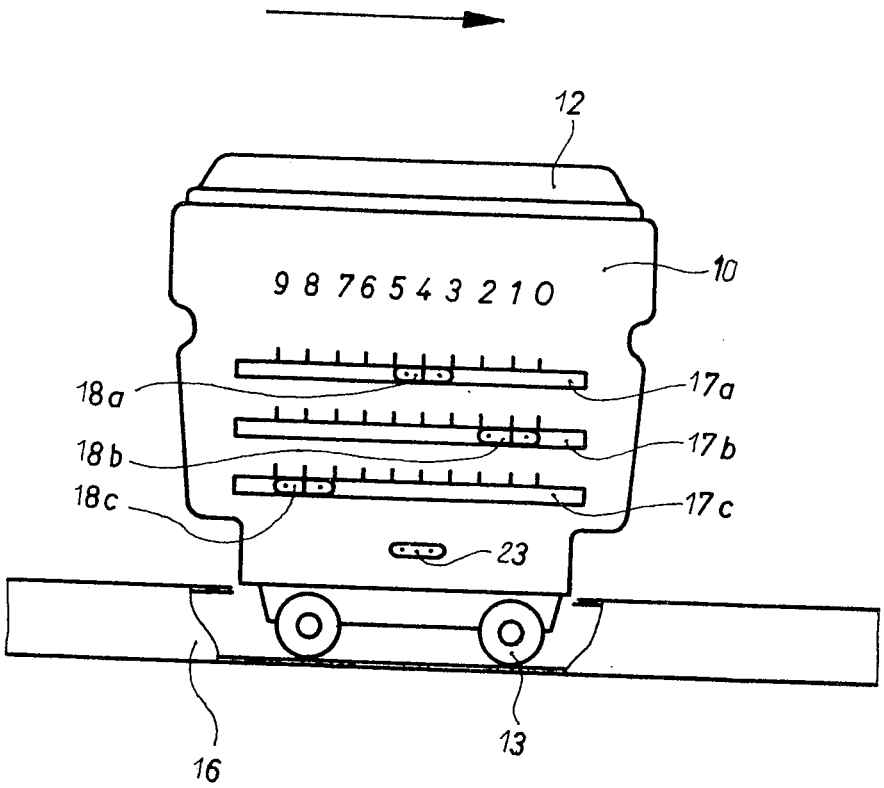
FIG. 3 is a side view of a car in accordance with this invention.

The system according to the present invention as shown in FIGS. 1, 2, and 3 has a plurality of cars 10 formed as hollow containers having an openable top 12 and two sides 11 extending generally parallel to the normal direction of displacement A of the car. Each car 10 is provided on its bottom with a pair of longitudinally extending flanges 15 in which is journaled a pair of axles 14 carrying wheels 13. Two of these wheels 13 are driven by an electric motor 27 in the car 10 which may receive its electric power either from commutator-type rails beneath the car or from a battery within the car. Thus each car is self-propelled.

One of the side walls 11 of the car is formed with three horizontal parallel slots 17*a*, 17*b*, and 17*c* each constituting a guide for a respective marker 18*a*, 18*b*, or 18*c*. Each of these markers is displaceable longitudinally within the respective guide and can be arrested in any of ten positions from a position 0 at the front of the car to a position 9 toward the rear thereof. In addition the side of the car is provided underneath the guides 17*a*–17*c* with a small permanent magnet 23.

Figure 4:
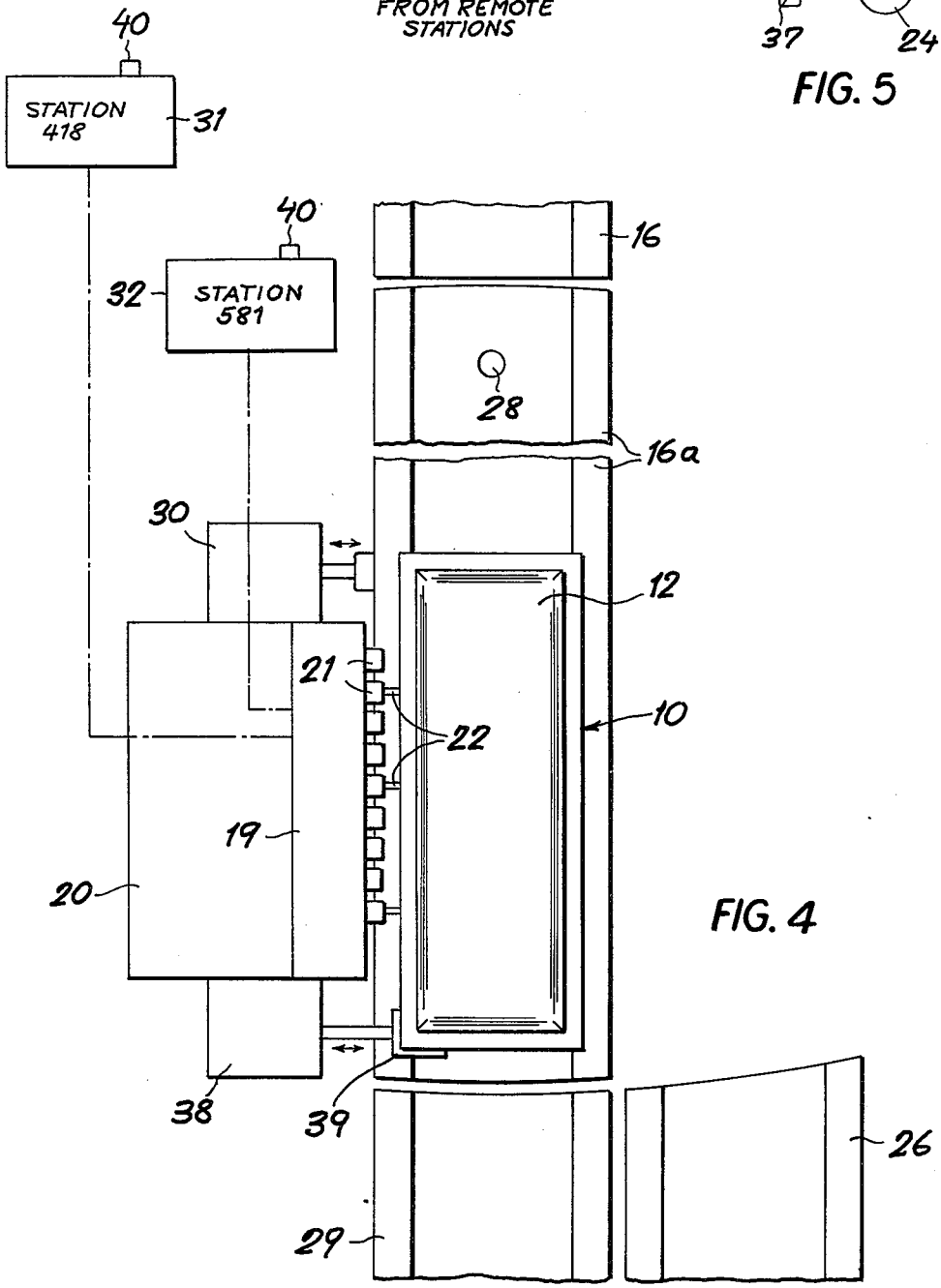
FIG. 4 is a top view of a portion of the system according to this invention.

The cars 10 are displaceable along track 16 formed generally of an elongated sheet-metal channel having bent-over lips 16' that engage over the wheels 13 of the cars and therefore insure that the cars cannot fall over. FIG. 4 shows an arrangement wherein a track section 16*a* is pivotal about a vertical axis 28 so as to connect an upstream track 16 either with a downstream section 29 or a siding section 26, depending on whether an actuator 30 is operated to pivot the downstream end of the section 16*a* either in line with the section 29 or with the section 26. In the conveyor system according to the present invention the holding area is provided having a track 16 which forms a loop past a plurality of remote stations such as the stations 31 and 32 in FIG. 4 with a siding arrangement in each of the stations. Each such station is provided with a sensor arrangement that can read the address code set on the car and, if this address code corresponds to the station code it will actuate its siding switch 30 to shunt the car off onto a siding shown at 26. In accordance with this invention each of the markers 18*a*, 18*b*, and 18*c* carries a small permanent magnet and a reader is provided at the station with four vertically spaced reed switches the upper three of which are arranged according to the appropriate address code so that when all four of the switches are across from a respective magnet the actuator 30 will be operated. FIG. 3 shows a car encoded to go to a station having code 418. The holding area is usually given the code 000, so that after the user has no more need for the car he need merely manually slide the markers 18*a*–*c* into the forward position and put it back on the track 16.

As shown in FIGS. 1, 2, and 4 a dispatcher 19 is provided adjacent the holding area and carried on a support 20. This dispatcher 19 is formed with three rows 21*a*, 21*b*, and 21*c* each having nine encoders 21. In addition a reed switch 24 is provided below the three rows 21*a*–*c* and alignable with the magnet 23.

Figure 5:
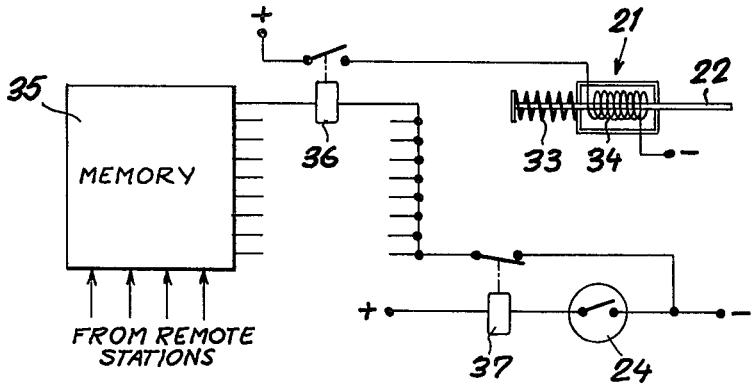
FIG. 5 is a schematic view of a detail of the circuit of the arrangement in accordance with the present invention.

Each of the encoders as shown in FIG. 5 comprises a core rod 22 normally biased by a spring 33 into a withdrawn position but operable by means of a coil 34 to extend from the dispatcher 19 and project into a respective guide 17*a*, 17*b*, or 17*c* and engage a respective marker 18*a*, 18*b*, or 18*c*. Each of the encoders 21 is therefore in a position corresponding to respective index position along the respective guides 17*a*–17*c*.

As further shown in FIG. 5 the dispatcher 19 has a memory 35 connected to all of the remote stations and itself connected to a relay 36 (only one shown) for each encoder 21. These relays 36 are all themselves operated through a normally closed relay 37 operated by the reed switch 24 so that when this reed switch 24 is actuated by approach thereto of the magnet 23 the relay 37 will open the circuit and cause any of the relays 36 that might be closed to open.

When a user wants a car sent to his station he merely presses a call button 40 at his station to automatically feed to the memory 35 a code corresponding to his station address code. With the system according to the present invention it is possible to use any code address from 111 to 999 so that the system may be extremely large. The called-in code is either fed immediately to the appropriate relays 36, causing the appropriate pins 22 to project from the approprite encoders 21, or is temporarily stored in the memory. Such a calling-in automatically advances a car 10 out of the holding area past the dispatcher 19. Since all of the markers 18*a*–*c* are in the fully forward 0 positions displacement of the car 10 past the dispatcher 19 having, for instance, the encoders corresponding to address code 581 protruding will cause the marker in the upper guide 17a to engage the upper rod 12 and slide to the fifth index position in this guide 17*a* and will cause corresponding sliding of the other markers 18*b* and 18*c* in their respective guides 17*b* and 17*c*. Once the guides 17*a*–17*c* are perfectly aligned with the row 21*a*–*c* the magnet 23 will align with the reed switch 24, opening the circuit to all of the relays 36 and causing instantaneous withdrawal of the rods 22. Such instantaneous withdrawal of these rods will leave the markers 18*a*–*c* in the index positions previously determined by the rods 22.

It is also possible to provide the dispatcher 19 as shown in FIG. 4 with a stopping device 38 having an abutment piece 39 that prevents travel of the car 10 past the aligned position with the dispatcher 19 until the rods 22 have been withdrawn. It is further possible to use the switch 24 to operate the actuator 30 in order to pull the car 10 away from the rods 22 rather than vice versa.

With the system according to the present invention it is possible to dispatch the cars 10 automatically and very rapidly to the remote stations. In a system having self-propelled cars, as shown, the cost of the cars is considerable so that rapid turnaround and dispatching is necessary in order to keep a minimum number of cars in the holding area and allow the capital investment to be minimized.

I claim:

1. A dispatching apparatus for a conveyor system having a plurality of cars displaceable along a track and each having a side provided with a plurality of parallel guides each in turn receiving a respective code marker slidable along the respective guide and arrestable therein at any of a plurality of predetermined index positions, whereby the pattern defined by said markers in said positions determines the path of travel of the respective car on said track, said apparatus comprising:

a support fixed adjacent said track;

a plurality of rows of encoders on said support, each row being alignable with a respective guide on a one of said cars and each encoder being alignable with a respective position on the respective guide, each encoder having a remotely operable abutment member projectable from said support into the respective guide, whereby displacement of a car past a support having one such member of each such row projecting from said support automatically displaces the respective markers along the respective guides; and means for displacing said abutment members and said side apart to disengage same when the guides of the car align with the rows of the support.

2. The apparatus defined in claim 1, further comprising means for arresting displacement of the car along said track on alignment of said rows with the guides on said car.

3. The apparatus defined in claim 1 wherein said means for displacing includes means for laterally displcing said car away from said support on alignment of said rows with said guides on said car.

4. The apparatus defined in claim 3 wherein said track includes two track sections next to each other and a displaceable track section adjacent said support and alignable with either of said two track sections, said means for laterally displacing serving to align said displaceable track section with either of said two track sections.

5. A dispatching apparatus for a conveyor system having a plurality of cars displaceable along a track and each having a side provided with a plurality of parallel guides each in turn receiving a respective code marker slidable along the respective guide and arrestable therein at any of a plurality of predetermined index positions, whereby the pattern defined by said markers in said positions determines the path of travel of the respective car on said track, said apparatus comprising:

a support fixed adjacent said track;

a plurality of rows of encoders on said support, each row being alignable with a respective guide on a one of said cars and each encoder being alignable with a respective position on the respective guide, each encoder having a remotely operable abutment member projectable from said support into the respective guide, whereby displacement of a car past a support having one such member of each such row projecting from said support automatically displaces the respective markers along the respective guides; and means for displacing said abutment members and said side apart to disengage same when the guides of the car align with the rows of the support, said means for displacing including means for withdrawing said abutment members into said support on alignment of said rows with said guides on said car.

6. The apparatus defined in claim 5 wherein said encoders each include a coil and a rod in said coil which constitutes said abutment member, said rod being displaceable between a withdrawn position unengageable with a marker in the respective guide and a projecting position engageable with a marker in the respective guide.

7. The apparatus defined in claim 6 wherein said means for displacing includes a first sensor body on said side and a second sensor body on said support alignable with said first body on alignment of said rows with said guides.

8. The apparatus defined in claim 7 wherein said first body is a permanent magnet and said second body has a reed switch.

9. The apparatus defined in claim 8 wherein said means for displacing includes circuit means connected in series with said reed switch for displacing said rods into said withdrawn position on alignment of said bodies.

10. The apparatus defined in claim 9 wherein said system has a plurality of remote stations each having a respective code, said apparatus further comprising memory means between said stations and said circuit means for storing the codes of stations calling for a car and sequentially feeding the stored codes to the appropriate encoders.

* * * * *